US010674890B1

(12) United States Patent
Armstrong

(10) Patent No.: US 10,674,890 B1
(45) Date of Patent: Jun. 9, 2020

(54) TABLEWARE DRYING DEVICE

(71) Applicant: Sherlock Armstrong, Far Rockaway, NY (US)

(72) Inventor: Sherlock Armstrong, Far Rockaway, NY (US)

( * ) Notice: Subject to any disclaimer, the term of this patent is extended or adjusted under 35 U.S.C. 154(b) by 0 days.

(21) Appl. No.: 16/445,329

(22) Filed: Jun. 19, 2019

(51) Int. Cl.
*A47L 19/04* (2006.01)

(52) U.S. Cl.
CPC ..... *A47L 19/04* (2013.01)

(58) Field of Classification Search
CPC ..... A47L 19/00; A47L 19/02; A47L 19/04
See application file for complete search history.

(56) References Cited

U.S. PATENT DOCUMENTS

| | | | | |
|---|---|---|---|---|
| 43,088 | A * | 6/1864 | Britain | A47L 19/04 220/572 |
| 2,247,932 | A * | 7/1941 | Wexler | A47L 19/04 211/41.3 |
| 2,459,921 | A * | 1/1949 | Burt Comer | B65D 71/0003 220/512 |
| 3,800,957 | A * | 4/1974 | Krause | A47B 81/04 211/41.3 |
| 5,184,749 | A * | 2/1993 | Attenasio | A47L 13/51 15/257.01 |
| 6,170,676 | B1 * | 1/2001 | Patadia | A47L 19/04 211/41.3 |
| 6,179,134 | B1 * | 1/2001 | Pine | A47L 19/04 211/41.3 |
| 6,502,704 | B2 | 1/2003 | Martorella | |
| 7,455,184 | B2 * | 11/2008 | Yang | A47L 19/04 211/41.4 |
| 8,573,410 | B2 | 11/2013 | Chalifoux | |
| D714,508 | S | 9/2014 | Joy | |
| 8,925,742 | B1 * | 1/2015 | Chitayat | A47L 19/04 211/132.1 |
| 8,925,743 | B1 * | 1/2015 | Lee | A47L 19/04 211/41.6 |
| 9,107,552 | B2 * | 8/2015 | Micek | A47L 19/04 |
| 9,730,571 | B1 * | 8/2017 | Lee | A47L 19/04 |
| 2008/0283480 | A1 | 11/2008 | Segull | |
| 2008/0308509 | A1 * | 12/2008 | Giuseppe | A47L 19/04 211/41.3 |
| 2010/0043249 | A1 | 2/2010 | Mulaw | |
| 2014/0366263 | A1 * | 12/2014 | Thompson | E03C 1/186 4/656 |
| 2018/0235434 | A1 * | 8/2018 | Sauceda | A46B 5/0016 |

FOREIGN PATENT DOCUMENTS

| | | | | |
|---|---|---|---|---|
| DE | 706307 C | * | 5/1941 | A47L 19/04 |
| FR | 1120625 A | * | 7/1956 | A47L 19/04 |

* cited by examiner

*Primary Examiner* — Stanton L Krycinski

(57) ABSTRACT

A tableware drying device for sanitary drying of tableware includes a first housing that is hingedly coupled to a second housing. The first housing has an upper facet and the second housing has an upper face, both of which are open so that the second housing is positioned to be hinged relative to the first housing to a closed configuration wherein contents of the first and second housing are shielded from dust, dirt, and insects. Each of a plurality of slats is coupled to and extends between opposing sides of the first housing to define a plurality of slots. Each slot is configured to insert an article of dishware that is to be air dried. Each of a plurality of couplers that is coupled to the second housing is configured to couple to a respective piece of glassware that is to be air dried.

17 Claims, 6 Drawing Sheets

TABLEWARE DRYING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to drying devices and more particularly pertain to a new drying device for sanitary drying of tableware.

BRIEF SUMMARY OF THE INVENTION

An embodiment of the disclosure meets the needs presented above by generally comprising a first housing that is hingedly coupled to a second housing. The first housing has an upper facet and the second housing has an upper face, both of which are open so that the second housing is positioned to be hinged relative to the first housing to a closed configuration wherein contents of the first and second housing are shielded from dust, dirt, and insects. Each of a plurality of slats is coupled to and extends between opposing sides of the first housing to define a plurality of slots. Each slot is configured to insert an article of dishware that is to be air dried. Each of a plurality of couplers that is coupled to the second housing is configured to couple to a respective piece of glassware that is to be air dried.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
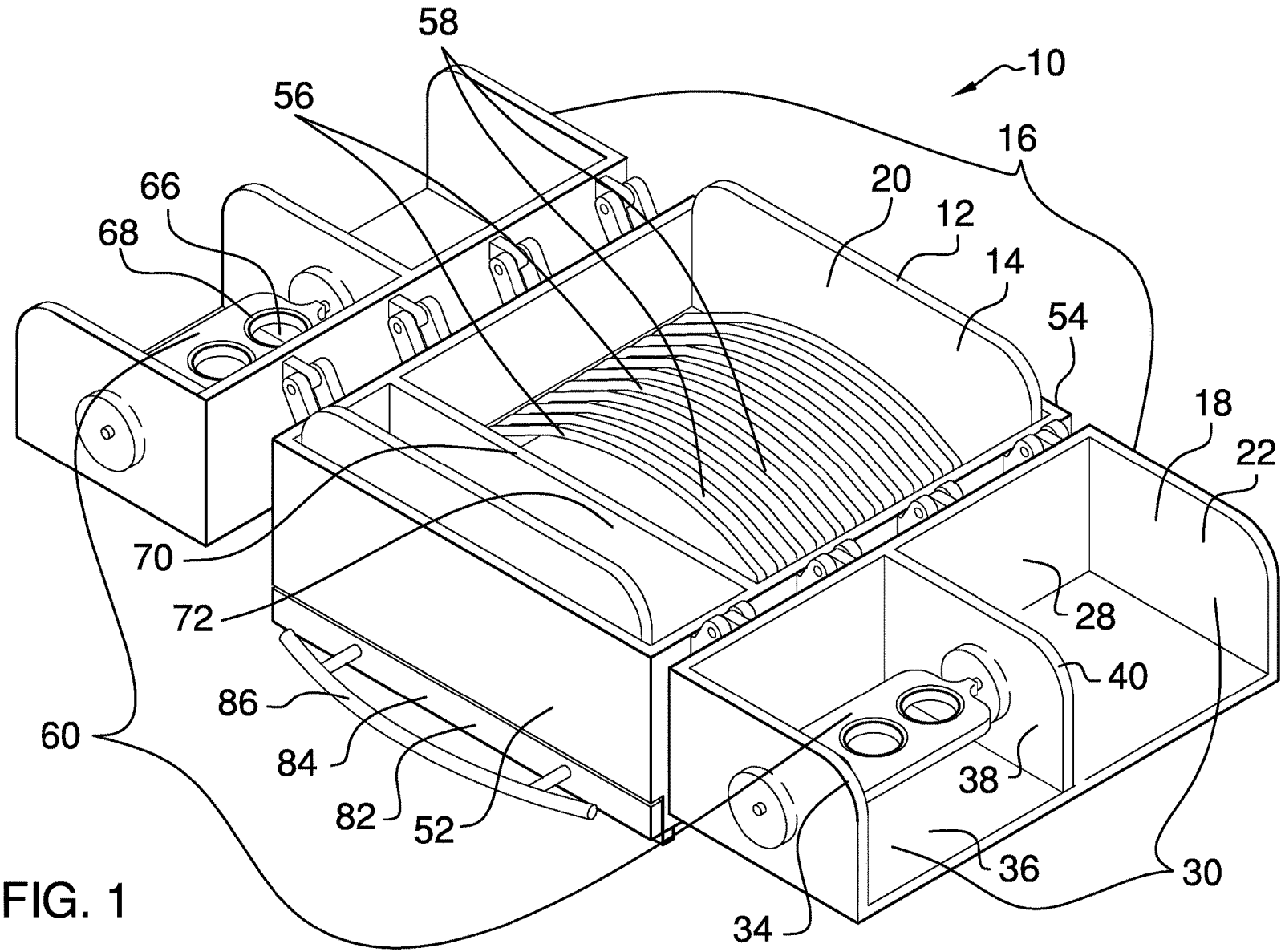
FIG. 1 is an isometric top front side perspective view of a tableware drying device according to an embodiment of the disclosure.
Figure 2:
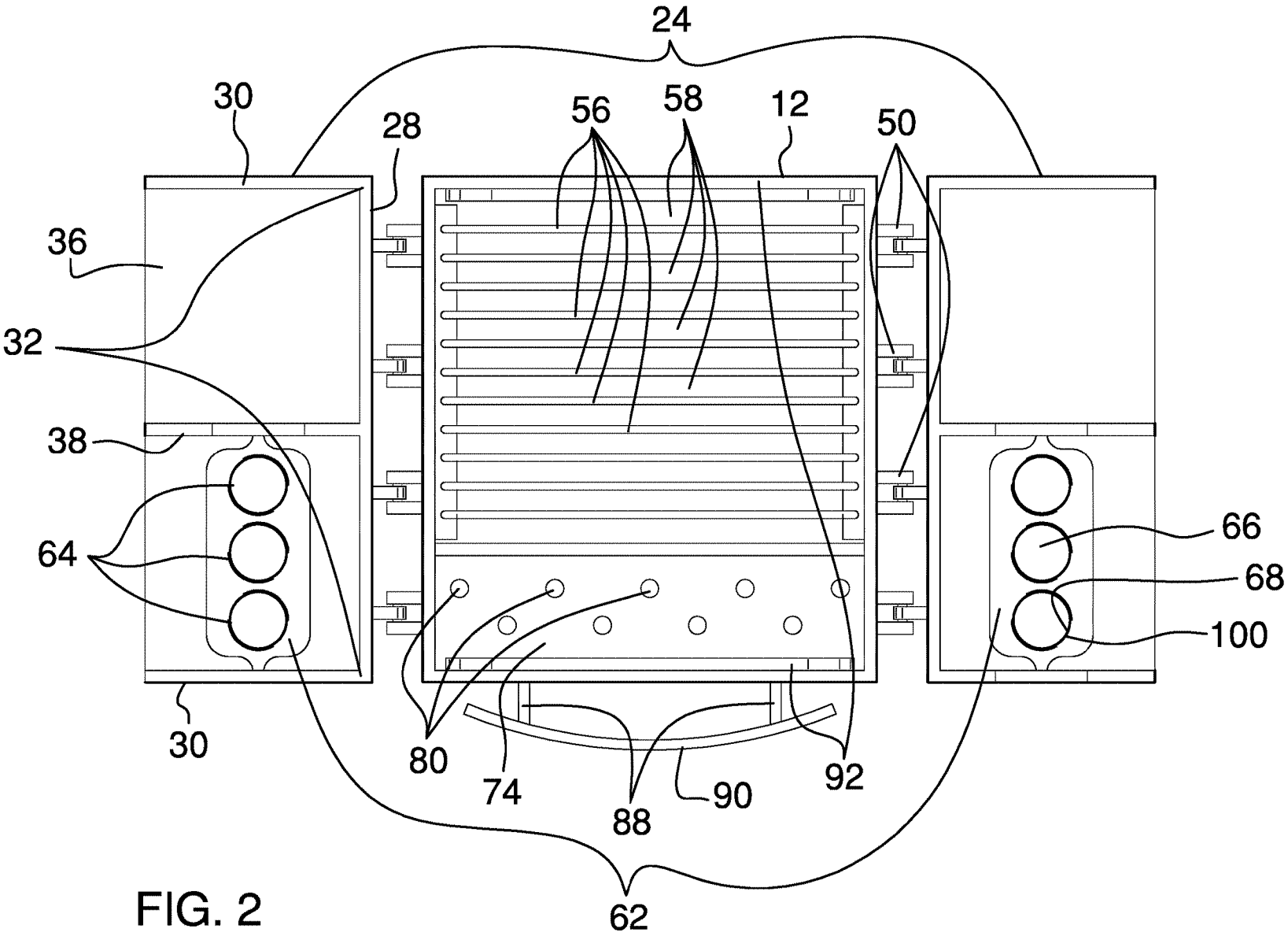
FIG. 2 is a top view of an embodiment of the disclosure.

With reference now to the drawings, and in particular to FIGS. 1 through 6 thereof, a new drying device embodying the principles and concepts of an embodiment of the disclosure and generally designated by the reference numeral 10 will be described.

As best illustrated in FIGS. 1 through 6, the tableware drying device 10 generally comprises a first housing 12 that defines an interior space 14 and a second housing 16 that defines an internal space 18. The first housing 12 is hingedly coupled to the second housing 16. The first housing 12 has an upper facet 20 that is open. The second housing 16 has an upper face 22 that is open. The second housing 16 is positioned to be hinged relative to the first housing 12 to a closed configuration wherein the interior space 14 and the internal space 18 are contiguous and are shielded from dust, dirt, and insects. The first housing 12 and the second housing 16 are substantially rectangularly box shaped. The first housing 12 and the second housing 16 may comprise plastic, or other substantially rigid material, such as, but not limited to stainless steel and the like.

Each of a set of four feet 96 is coupled to the first housing 12 proximate to a respective lower corner 98 of the first housing 12. The set of four feet 96 is configured to stabilize the first housing 12 on a substantially horizontal surface, such as a countertop proximate to a sink.

The second housing 16 comprises a pair of half housings 24. Each half housing 24 is hingedly coupled to a respective opposing side 26 of the first housing 12 so that the half housings 24 are positioned to be hinged relative to the first housing 12 to the closed configuration. Each half housing 24 comprises an inside wall 28 that is hingedly coupled to the first housing 12. Each of a pair of end walls 30 is coupled to and extends perpendicularly from a respective opposing end 32 of the inside wall 28. A distal corner 34 of the end wall 30 is arcuate. A upper half wall 36 is coupled to and extends between the pair of end walls 30 and the inside wall 28. A medial wall 38 is coupled to and extends perpendicularly from the inside wall 28. The medial wall 38 is positioned substantially equally distant from the end walls 30. An outside corner 40 of the medial wall 38 is arcuate.

Each of a pair of handles 42 is coupled to an upper half face 44 of a respective half housing 24. The handle 42 is configured to be grasped in a hand of a user to hinge the respective half housing 24 relative to the first housing 12. The handle 42 may comprise a pair of first rods 46 and a second rod 48, or other grasping means, such as, but not limited to a strap, a molded protrusion, and the like. Each first rod 46 is coupled to and extends perpendicularly from the respective half housing 24. The second rod 48 is coupled to and extends arcuately between the pair of first rods 46.

Each of a plurality of hinges 50 is coupled to and extends between a respective half housing 24 and the first housing 12 so that the respective half housing 24 is hingedly coupled to the first housing 12. The plurality of hinges 50 comprises eight hinges 50 that are coupled four apiece to each opposing side 26 of the first housing 12. The hinges 50 are substantially evenly space between a first end 52 and a second end 54 of the first housing 12.

Figure 3:
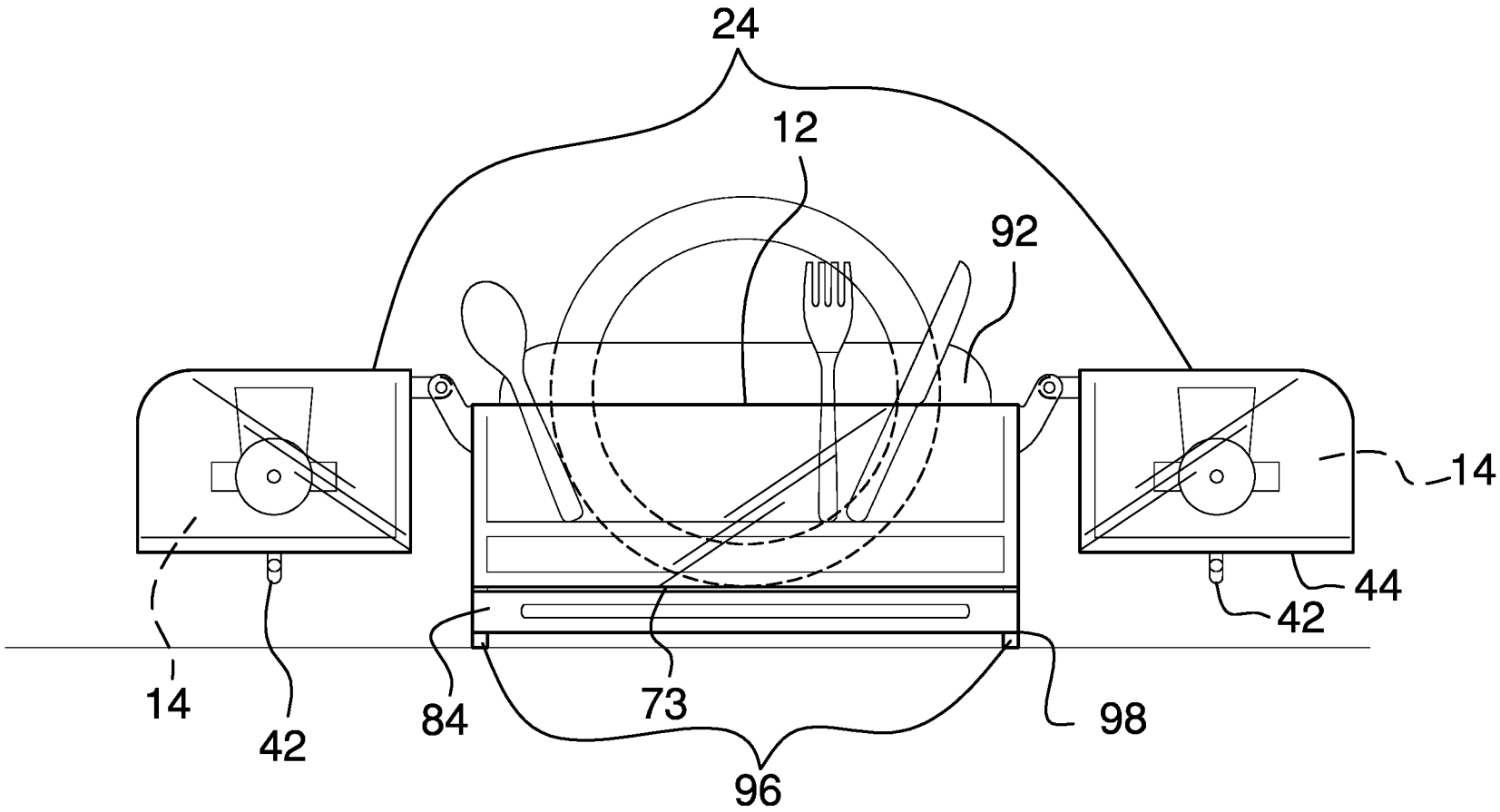
FIG. 3 is a front view of an embodiment of the disclosure.

A plurality of slats 56 is positioned in the interior space 14. Each slat 56 is coupled to and extends between the opposing sides 26 of the first housing 12 so that the plurality of slats 56 defines a plurality of slots 58. Each slot 58 is configured to insert an article of dishware to air dry the article of dishware, such as a plate as shown in FIG. 3.

A plurality of couplers 60 is coupled to the second housing 16 and is positioned in the internal space 18. Each coupler 60 is configured to couple to a respective piece of glassware, such as a plate and a bowl, to air dry the respective piece of glassware, such as a cup as shown in FIG. 3.

Figure 4:
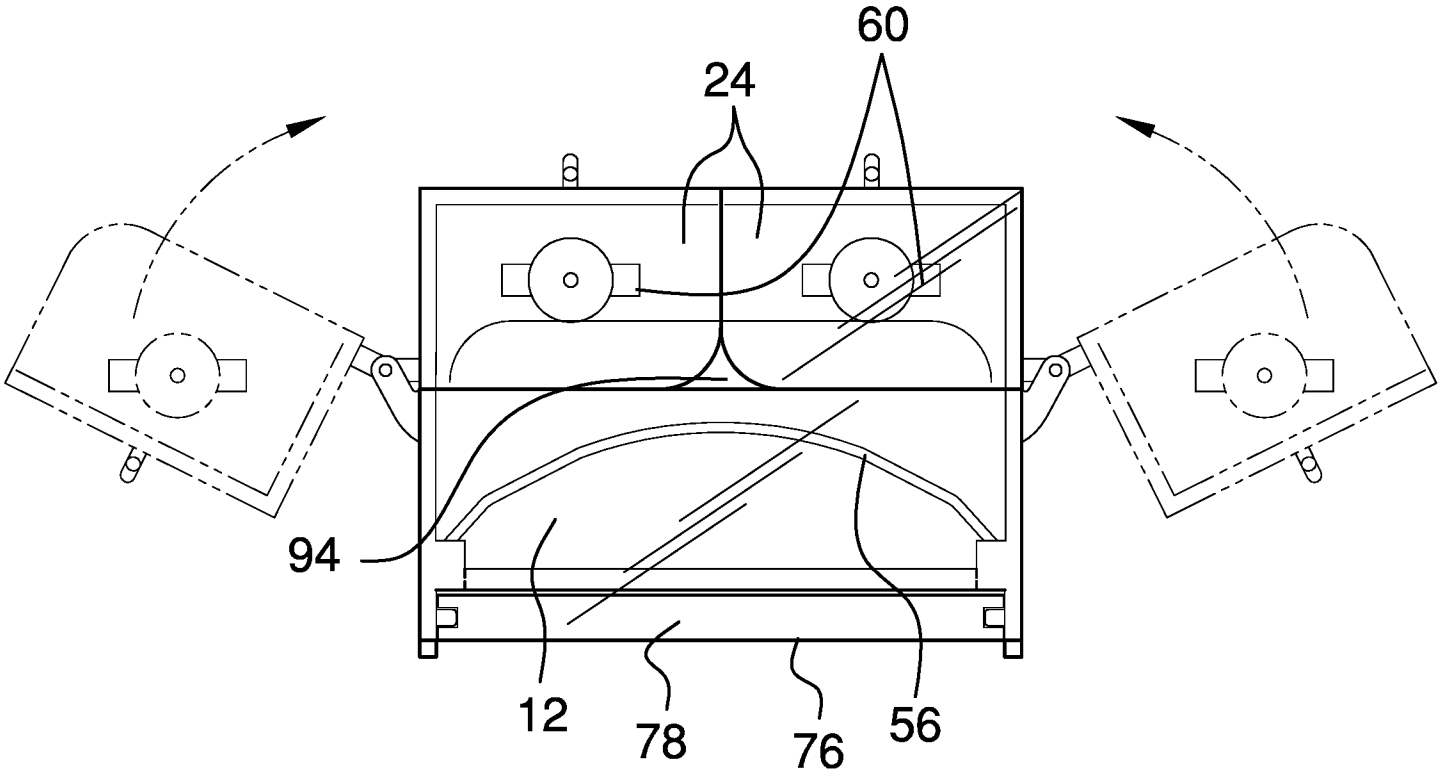
FIG. 4 is a rear view of an embodiment of the disclosure.

The plurality of couplers 60 comprises a pair of plates 62 and a plurality of fasteners 64. Each plate 62 is coupled to and extends between a medial wall 38 and a respective end wall 30 of a respective half housing 24. Each fastener 64 is coupled to a respective plate 62 and is configured to removably couple to the respective piece of glassware. The plurality of fasteners 64 comprises six fasteners 64 that are coupled three apiece to each plate 62. Each fastener 64 may comprise a hole 66 that is positioned through the plate 62 and a gasket 68 that is coupled to a circumference 100 of the hole 66, or other fastening means, such as, but not limited to, slots positioned in a plate to accept a stem, clamps, and the like. The hole 66 is configured to insert the respective piece of glassware so that the respective piece of glassware is frictionally coupled to the plate 62 by the gasket 68. The plate 62 is rotationally coupled to the medial wall 38 and the respective end wall 30, as shown in FIG. 4.

A cross plate 70 that is coupled to and extends between the opposing sides 26 of the first housing 12 proximate to the first end 52 of the first housing 12 defines a compartment 72. The compartment 72 is configured to insert an item of flatware, such as a knife, fork, and spoon, as shown in FIG. 3.

Figure 5:
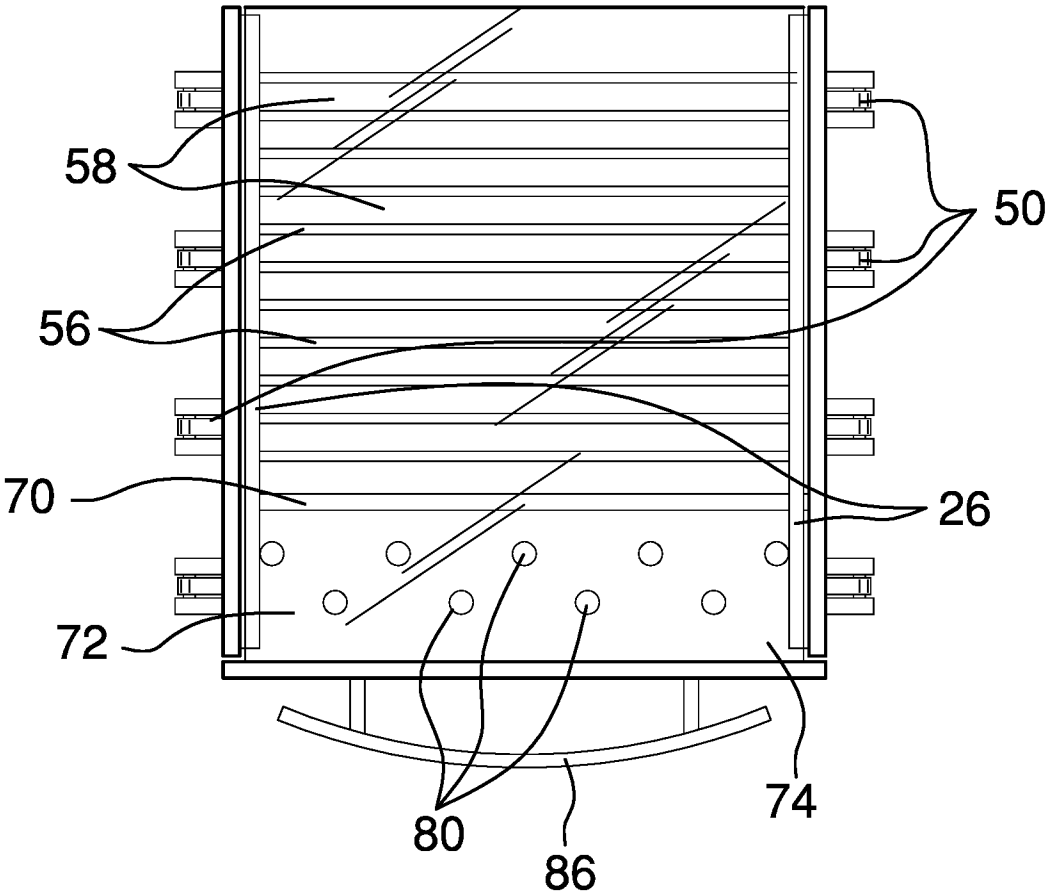
FIG. 5 is a bottom view of an embodiment of the disclosure.
Figure 6:
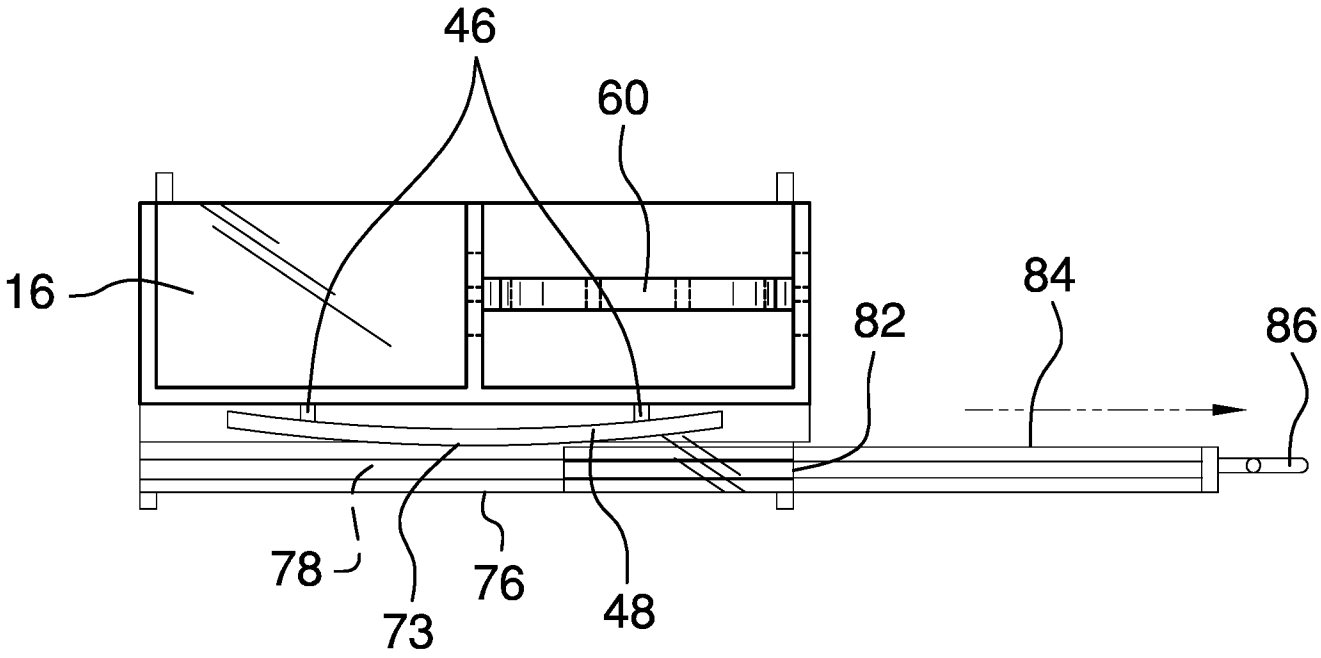
FIG. 6 is a side view of an embodiment of the disclosure.

A bottom plate 74 that is coupled to the first housing 12 and positioned in the interior space 14 proximate to a lower facet 76 of the first housing 12 defines a drain 78 that is positioned between the bottom plate 74 and the lower facet 76. The bottom plate 74 extends transversely and upwardly from the first end 52 to the second end 54 of the first housing 12 so that the bottom plate 74 is configured to direct water toward the first end 52. A plurality of orifices 80 that is positioned in the bottom plate 74 proximate to the first end 52 of the first housing 12, as shown in FIG. 5, is configured to allow water to flow into the drain 78.

An opening 82 that is positioned in the first end 52 of the first housing 12 proximate to the lower facet 76 opens into the drain 78. A tray 84 that is positioned to be inserted through the opening 82 into the drain 78 is configured to collect water that drains through the plurality of orifices 80.

A grasp 86 that is coupled to the tray 84 is configured to be gripped in the hand of the user to selectively position the tray 84 in the drain 78. The grasp 86 may comprise a pair of first bars 88 and a second bar 90, or other grasping means, such as, but not limited to a strap, a molded protrusion, and the like. Each first bar 88 is coupled to and extends perpendicularly from the tray 84. The second bar 90 is coupled to and extends arcuately between the pair of first bars 88. Each first bar 88 and the second bar 90 are circularly shaped when viewed longitudinally.

A pair of endplates 92 is positioned in the interior space 14 and extends through the upper facet 20 of the first housing 12. The endplates 92 are coupled singly to the first end 52 and the second end 54 of the first housing 12 so that each endplate 92 is positioned to seal a respective aperture 94 that is defined by the distal corners 34 of associated end walls 30 with the half housings 24 in the closed configuration.

In use, the device 10 is placed on the substantially horizontal surface. The half housings 24 are hinged to an open configuration to expose the plurality of slots 58, the compartment 72, and the holes 66 in the plates 62, as shown in FIG. 3. The user inserts the dishware into the slots 58, the flatware into the compartment 72, and the glassware into the holes 66, then hinges the half housings 24 to the closed configuration, as shown in FIG. 4, so that the contents are protected from dust, dirt, and insects while air drying.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A tableware drying device comprising:

a first housing defining an interior space hingedly coupled to a second housing defining an internal space, the first housing having an upper facet, the upper facet being open, the second housing having an upper face, the upper face being open such that the second housing is positioned for hinging relative to the first housing to a closed configuration wherein the interior space and the internal space are contiguous and are shielded from dust, dirt, and insects, the first housing and the second housing being substantially rectangularly box shaped, the first housing and the second housing comprising plastic, the second housing comprising a pair of half housings, each half housing being hingedly coupled to a respective opposing side of the first housing such that the half housings are positioned for hinging relative to the first housing to the closed configuration, each half housing comprising an inside wall hingedly coupled to the first housing, a pair of end walls, each end wall being coupled to and extending perpendicularly from a respective opposing end of the inside wall, a upper half wall coupled to and extending between the pair of end walls and the inside wall, and a medial wall coupled to and extending perpendicularly from the inside wall, the medial wall being positioned substantially equally distant from the end walls;

a plurality of slats positioned in the interior space, each slat being coupled to and extending between opposing sides of the first housing such that the plurality of slats defines a plurality of slots wherein each slot is configured for inserting an article of dishware for air drying the article of dishware;

a plurality of couplers coupled to the second housing and positioned in the internal space wherein each coupler is configured for coupling to a respective piece of glassware for air drying the respective piece of glassware; and a set of four feet, each foot being coupled to the first housing proximate to a respective lower corner of the first housing wherein the set of four feet is configured for stabilizing the first housing on a substantially horizontal surface.

2. The device of claim 1, further including an outside corner of the medial wall being arcuate.

3. The device of claim 1, further including a pair of handles, each handle being coupled to an upper half face of a respective half housing wherein the handle is configured for grasping in a hand of a user for hinging the respective half housing relative to the first housing.

4. The device of claim 3, further including the handle comprising a pair of first rods and a second rod, each first rod being coupled to and extending perpendicularly from the respective half housing, the second rod being coupled to and extending arcuately between the pair of first rods.

5. The device of claim 1, further including a plurality of hinges, each hinge being coupled to and extending between a respective half housing and the first housing such that the respective half housing is hingedly coupled to the first housing.

6. The device of claim 5, further including the plurality of hinges comprising eight hinges coupled four apiece to each opposing side of the first housing, the hinges being substantially evenly space between a first end and a second end of the first housing.

7. The device of claim 1, further including the plurality of couplers comprising a pair of plates and a plurality of fasteners, each plate being coupled to and extending between a medial wall and a respective end wall of a respective half housing, each fastener being coupled to a respective plate wherein the fastener is configured for removably coupling to the respective piece of glassware.

8. The device of claim 7, further including the plurality of fasteners comprising six fasteners coupled three apiece to each plate.

9. The device of claim 7, further including each fastener comprising a hole positioned through the plate and a gasket coupled to a circumference of the hole wherein the hole is configured for inserting the respective piece of glassware such that the respective piece of glassware is frictionally coupled to the plate by the gasket.

10. The device of claim 7, further including the plate being rotationally coupled to the medial wall and the respective end wall.

11. The device of claim 1, further including a cross plate coupled to and extending between the opposing sides of the first housing proximate to a first end of the first housing defining a compartment wherein the compartment is configured for inserting an item of flatware.

12. The device of claim 1, further comprising:

a bottom plate coupled to the first housing and positioned in the interior space proximate to a lower facet of the first housing defining a drain positioned between the bottom plate and the lower facet, the bottom plate extending transversely and upwardly from a first end to a second end of the first housing wherein the bottom plate is configured for directing water toward the first end; and a plurality of orifices positioned in the bottom plate proximate to the first end of the first housing wherein the plurality of orifices is configured for flowing of water into the drain.

13. The device of claim 12, further comprising:

an opening positioned in the first end of the first housing proximate to the lower facet such that the opening opens into the drain; and a tray positioned for inserting through the opening into the drain wherein the tray is configured for collecting water draining through the plurality of orifices.

14. The device of claim 13, further including a grasp coupled to the tray wherein the grasp is configured for gripping in the hand of the user for selectively positioning the tray in the drain.

15. The device of claim 14, further including the grasp comprising a pair of first bars and a second bar, each first bar being coupled to and extending perpendicularly from the tray, the second bar being coupled to and extending arcuately between the pair of first bars, each first bar and the second bar being circularly shaped when viewed longitudinally.

16. The device of claim 1, further comprising:

a distal corner of the end wall being arcuate; and a pair of endplates positioned in the interior space and extending through the upper facet of the first housing, the endplates being coupled singly to a first end and a second end of the first housing such that each endplate is positioned for sealing a respective aperture defined by distal corners of associated end walls with the half housings in the closed configuration.

17. A tableware drying device comprising:

a first housing defining an interior space hingedly coupled to a second housing defining an internal space, the first housing having an upper facet, the upper facet being open, the second housing having an upper face, the upper face being open such that the second housing is positioned for hinging relative to the first housing to a closed configuration wherein the interior space and the internal space are contiguous and are shielded from dust, dirt, and insects, the first housing and the second housing being substantially rectangularly box shaped, the first housing and the second housing comprising plastic, the second housing comprising a pair of half housings, each half housing being hingedly coupled to a respective opposing side of the first housing such that the half housings are positioned for hinging relative to the first housing to the closed configuration, each half housing comprising:

an inside wall hingedly coupled to the first housing, a pair of end walls, each end wall being coupled to and extending perpendicularly from a respective opposing end of the inside wall, a distal corner of the end wall being arcuate, a upper half wall coupled to and extending between the pair of end walls and the inside wall, and a medial wall coupled to and extending perpendicularly from the inside wall, the medial wall being positioned substantially equally distant from the end walls, an outside corner of the medial wall being arcuate;

a set of four feet, each foot being coupled to the first housing proximate to a respective lower corner of the first housing wherein the set of four feet is configured for stabilizing the first housing on a substantially horizontal surface;

a pair of handles, each handle being coupled to an upper half face of a respective half housing wherein the handle is configured for grasping in a hand of a user for hinging the respective half housing relative to the first housing, the handle comprising a pair of first rods and a second rod, each first rod being coupled to and extending perpendicularly from the respective half housing, the second rod being coupled to and extending arcuately between the pair of first rods;

a plurality of hinges, each hinge being coupled to and extending between a respective half housing and the first housing such that the respective half housing is hingedly coupled to the first housing, the plurality of hinges comprising eight hinges coupled four apiece to each opposing side of the first housing, the hinges being substantially evenly space between a first end and a second end of the first housing;

a plurality of slats positioned in the interior space, each slat being coupled to and extending between the opposing sides of the first housing such that the plurality of slats defines a plurality of slots wherein each slot is configured for inserting an article of dishware for air drying the article of dishware;

a plurality of couplers coupled to the second housing and positioned in the internal space wherein each coupler is configured for coupling to a respective piece of glassware for air drying the respective piece of glassware, the plurality of couplers comprising a pair of plates and a plurality of fasteners, each plate being coupled to and extending between a medial wall and a respective end wall of a respective half housing, each fastener being coupled to a respective plate wherein the fastener is configured for removably coupling to the respective piece of glassware, the plurality of fasteners comprising six fasteners coupled three apiece to each plate, each fastener comprising a hole positioned through the plate and a gasket coupled to a circumference of the hole wherein the hole is configured for inserting the respective piece of glassware such that the respective piece of glassware is frictionally coupled to the plate by the gasket, the plate being rotationally coupled to the medial wall and the respective end wall;

a cross plate coupled to and extending between the opposing sides of the first housing proximate to the first end of the first housing defining a compartment wherein the compartment is configured for inserting an item of flatware;

a bottom plate coupled to the first housing and positioned in the interior space proximate to a lower facet of the first housing defining a drain positioned between the bottom plate and the lower facet, the bottom plate extending transversely and upwardly from the first end to the second end of the first housing wherein the bottom plate is configured for directing water toward the first end;

a plurality of orifices positioned in the bottom plate proximate to the first end of the first housing wherein the plurality of orifices is configured for flowing of water into the drain;

an opening positioned in the first end of the first housing proximate to the lower facet such that the opening opens into the drain;

a tray positioned for inserting through the opening into the drain wherein the tray is configured for collecting water draining through the plurality of orifices;

a grasp coupled to the tray wherein the grasp is configured for gripping in the hand of the user for selectively positioning the tray in the drain, the grasp comprising a pair of first bars and a second bar, each first bar being coupled to and extending perpendicularly from the tray, the second bar being coupled to and extending arcuately between the pair of first bars, each first bar and the second bar being circularly shaped when viewed longitudinally; and a pair of endplates positioned in the interior space and extending through the upper facet of the first housing, the endplates being coupled singly to the first end and the second end of the first housing such that each endplate is positioned for sealing a respective aperture defined by distal corners of associated end walls with the half housings in the closed configuration.

* * * * *